United States Patent [19]

Bridges et al.

[11] Patent Number: 4,821,798

[45] Date of Patent: Apr. 18, 1989

[54] HEATING SYSTEM FOR RATHOLE OIL WELL

[75] Inventors: Jack E. Bridges, Park Ridge, Ill.; Vincent Young, Tulsa, Okla.

[73] Assignee: ORS Development Corporation, Tulsa, Okla.

[21] Appl. No.: 59,956

[22] Filed: Jun. 9, 1987

[51] Int. Cl.[4] ..... E21B 43/24

[52] U.S. Cl. ..... 166/60; 166/65.1; 166/248

[58] Field of Search ..... 166/248, 60, 65.1, 272

[56] References Cited

U.S. PATENT DOCUMENTS

| | | | |
|---|---|---|---|
| 3,097,699 | 7/1963 | Orr | 166/289 X |
| 3,213,942 | 10/1965 | Nixon | 166/60 |
| 3,547,193 | 12/1970 | Gill | 166/248 |
| 3,605,888 | 9/1971 | Crowson et al. | 166/248 |
| 3,614,986 | 10/1971 | Gill | 166/303 |
| 3,620,300 | 11/1971 | Crowson | 166/248 |
| 3,642,066 | 2/1972 | Gill | 166/248 |
| 4,199,025 | 4/1980 | Carpenter | 166/248 |
| 4,463,805 | 8/1984 | Bingham | 166/248 |
| 4,466,484 | 8/1984 | Kermabon | 166/60 |
| 4,484,627 | 11/1984 | Perkins | 166/248 |
| 4,499,948 | 2/1985 | Perkins | 166/248 |
| 4,524,827 | 6/1985 | Bridges et al. | 166/248 |
| 4,567,945 | 2/1986 | Segalman | 166/248 |
| 4,662,437 | 5/1987 | Renfro | 166/65.1 |
| 4,662,438 | 5/1987 | Taflove et al. | 166/245 |
| 4,730,671 | 3/1988 | Perkins | 166/248 |

OTHER PUBLICATIONS

World Oil, "AC Current Heats Heavy Oil for Extra Recovery", May 1970, pp. 83–86.

*Primary Examiner*—Hoang C. Dang

*Attorney, Agent, or Firm*—Kinzer, Plyer, Dorn, McEachran & Jambor

[57] ABSTRACT

An electrical heating system for an oil well of the kind comprising a well bore extending through and below an oil producing formation to afford a rathole of substantial depth, the well including an electrically conductive first casing section from the earth surface down through the overburden, an electrically conductive second casing section continuing down through the oil producing formation, and a third casing section in the rathole. The first and second casing sections are usually steel pipe. An electrical power supply is connected to primary and secondary electrodes for conductive heating of a portion of the oil producing formation; the primary electrode is an uninsulated portion of the second casing section. The third casing section constitutes an insulator for electrical isolation of the rathole. The first casing section preferably has external insulation for most of its length, and any conductive casing sections extending down below the third casing section, including a float shoe housing if present, preferably has both external and internal electrical insulation.

19 Claims, 3 Drawing Sheets

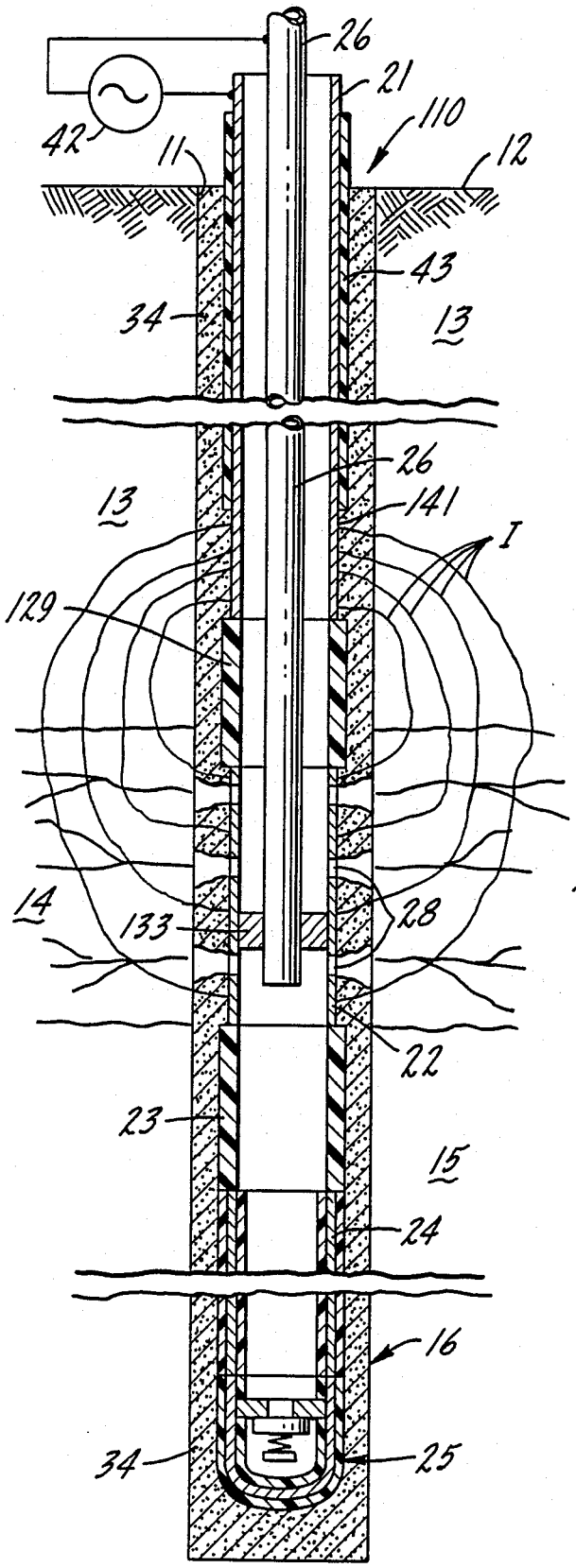
Fig. 2.
Fig. 2A.
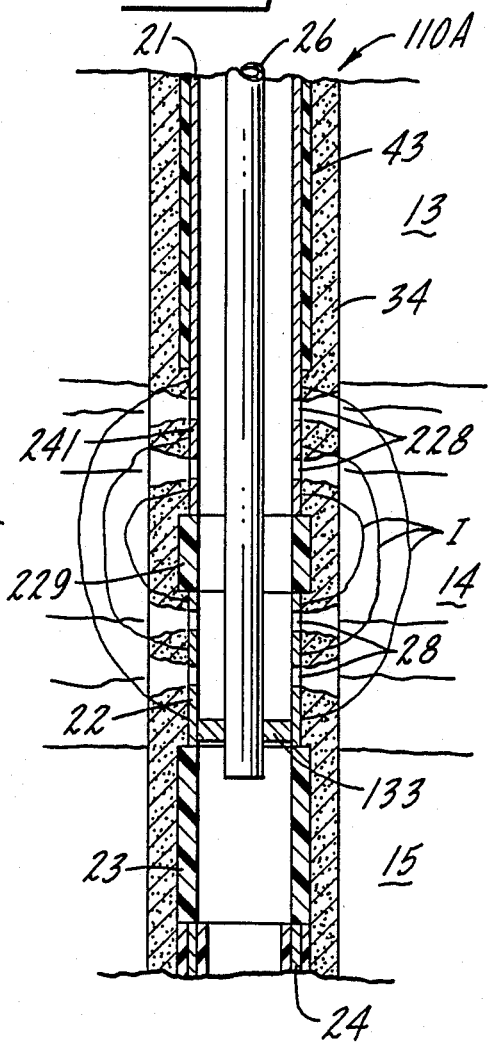

HEATING SYSTEM FOR RATHOLE OIL WELL

BACKGROUND OF THE INVENTION

A major difficulty in extracting oil from deposits of heavy, viscous oils or from tar sand deposits results from the poor mobility of the oil in the requisite movement through the deposit and into an oil well. A number of different techniques and apparatus have been developed for reducing the viscosity of the oil by increasing its temperature. In many instances this is accomplished by electrical heating, including particularly conductive heating of a portion of the oil producing formation or "pay zone" adjacent to the well.

In many oil wells it is necessary to perforate that part of a metal well casing that is located in the oil producing formation in order to admit oil into the casing. Customarily, the casing is made of steel pipe. Perforation is usually accomplished by lowering a perforating tool or "gun" into the well casing to the level of the oil producing formation. At that level, the gun fires explosive charges radially outwardly through the casing to form the necessary perforations. Inevitably, this produces a certain amount of debris in and around the well casing, some of the debris constituting sand and other solid particles in the oil deposit that will ultimately find their way into the well. It may also be necessary to employ one or more of various explosive and pressure techniques that fracture the structure of the oil producing formation itself in order to afford convenient and effective passages for the flow of oil from the deposit to the well. Again, these various formation fracturing techniques produce appreciable amounts of sand and other debris which tends to flow to and accumulate in the oil well.

In any of these wells, it may be highly desirable or even essential to provide a rathole. A rathole is a void or space, usually a cased portion of the borehole, that extends generally coaxially of the well bore, to an appreciable distance below the oil producing formation. The rathole affords a deep sump for collecting sand and other solid debris from the perforation and fracturing processes and from other sources, so that this debris cannot accumulate in the well bore immediately adjacent to the pay zone and hence cannot interfere with efficient and effective operation of the well. In many wells the rathole may serve another function, permitting logging instruments or other tools to be positioned in the well below the oil producing formation.

In most electrical well heating systems the steel or other metal casing of the well forms a part of the electrical heating apparatus. If ordinary steel casing were employed in the rathole, as a direct extension of the main well casing, it would be electrically connected or coupled into the heating system and would heat a barren portion of the underburden formations around the well bore below the pay zone. The same situation applies to the metal housing for a float shoe, as usually used in oil wells having cement in the space between the casing and the surrounding formations. Thus, any metal casing that continues downwardly into the rathole and any conductive float shoe housing may represent a substantial source of inefficiency, due to wasted heating of the barren formations surrounding the rathole.

SUMMARY OF THE INVENTION

It is a principal object of the present invention, therefore, to provide a new and improved electrical heating system for a rathole-type oil well that permits the use of ordinary steel pipe or other conductive casing throughout most of the well, including the rathole, while avoiding wasteful heating of formations in the underburden below the oil producing formation.

It is a further object of the invention to provide a new and improved electrical heating system for oil wells producing viscous oils from heavy oil deposits and tar sand deposits that allows for the use of a rathole in the oil well without material reduction in the efficiency of the electrical heating system and that is applicable to both monopole and dipole electrical heating arrangements.

Accordingly, the invention relates to a heating system for an oil well of the kind comprising a well bore extending downwardly from the surface of the earth through one or more overburden formations and through an oil producing formation, and further into an underburden formation below the producing formation to afford a rathole of substantial depth, an electrically conductive first casing section extending from the surface of the earth down into the well bore to a depth adjacent the top of the oil producing formation, an electrically conductive second casing section extending downwardly from the first casing section through the oil producing formation, and a third casing section extending downwardly from the second casing section into the rathole. The electrical heating system, used for heating a portion of the oil producing formation, comprises at least one portion of the second casing section having an uninsulated surface to afford a primary heating electrode within the oil producing formation, a secondary electrode positioned within one of the overburden and oil producing formations, and an electrical power supply connected to the primary and secondary electrodes to energize those electrodes for conduction heating of a portion of the oil producing formation adjacent the well. The third casing section constitutes an electrical insulator casing, electrically isolating the rathole from the first and second casing sections, and the third casing section has a length at least equal to three times the diameter of the well bore. The third casing section is formed essentially entirely of electrical insulator material.

BRIEF DESCRIPTION OF THE DRAWINGS

FIG. 2 is a simplified schematic sectional elevation view of a different monopole heating system according to a further embodiment of the invention;

FIG. 2A is a detail view of a modification of the system of FIG. 2 to afford a single-well dipole heating system.

DESCRIPTION OF THE PREFERRED EMBODIMENTS

Figure 1:
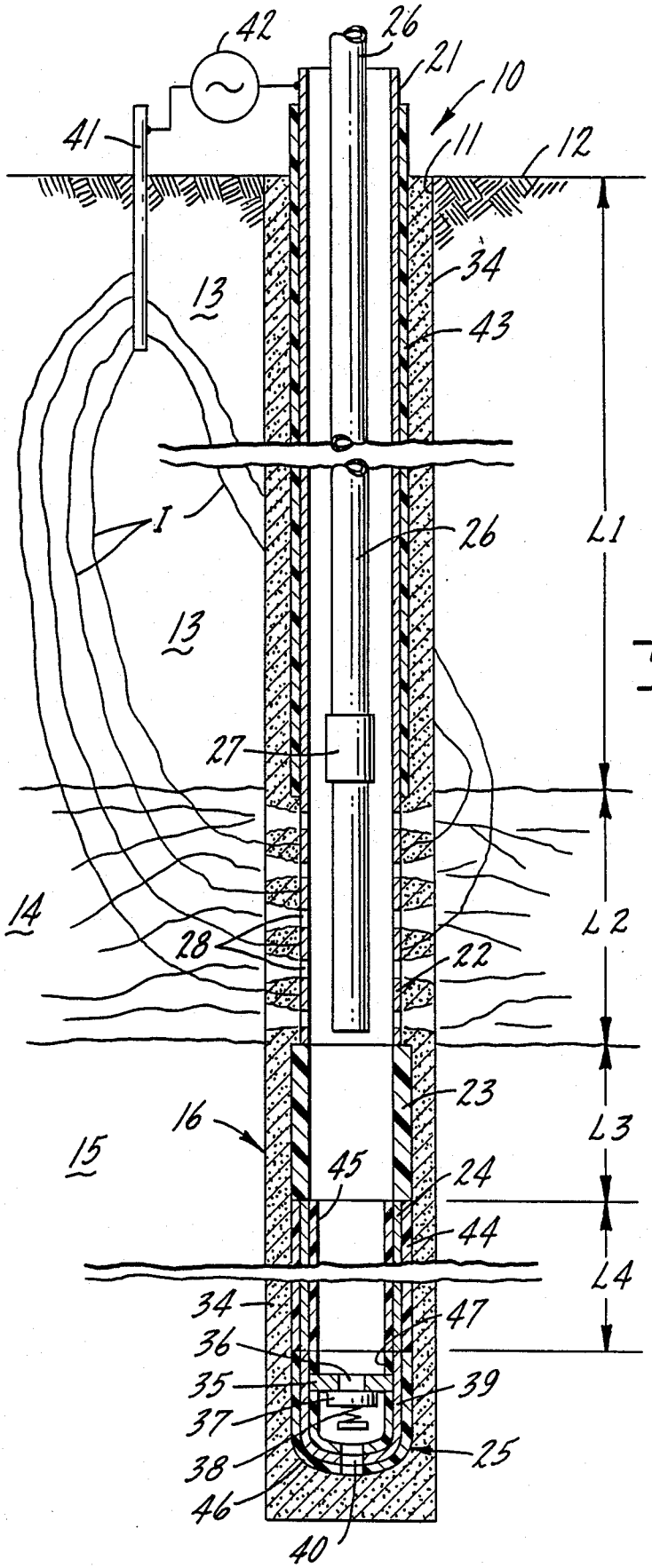
FIG. 1 is a simplified schematic sectional elevation view of a rathole-type oil well equipped with a monopole electrical heating system comprising one embodiment of the invention.

FIG. 1 is a simplified schematic sectional elevation view of an oil well 10 equipped with a monopole electrical heating system comprising one embodiment of the present invention. Oil well 10 comprises a well bore 11 that extends downwardly from the surface of the earth 12 through one or more overburden formations 13 and through an oil producing formation or pay zone 14. Well bore 11 continues downwardly below the producing formation 14 into an underburden formation 15, affording a rathole 16 of substantial depth.

An electrically conductive first casing section 21, usually constructed of steel pipe having a diameter of about 5.5 inches, extends down into well bore 11. This first casing section 21 is continuous for a length L1 that ends approximately at the top of pay zone 14. The casing in oil well 10 continues downwardly from section 21 as an electrically conductive second casing section 22. This second conductive casing section 22 has a length L2 such that it extends approximately to the bottom of the oil producing formation 14. Casing section 22 may be a direct continuation of casing section 21 and, like the first casing section, may be formed of conventional steel pipe.

As in most oil wells of the rathole type, the casing in well 10 extends down into rathole 16 for a substantial depth below pay zone 14. Immediately below the second conductive casing section 22 there is a third casing section 23 that projects into rathole 16. Casing section 23 is formed of an insulator material, preferably an appropriate pipe of resin-impregnated fiberglass, having appropriate physical properties as well as constituting a high dielectric insulator. The length of the third casing section 23 is designated as L3 in FIG. 1. Below the third casing section 23 there is a fourth casing section 24. Section 24 is preferably formed of conventional steel pipe. Its length is indicated as L4. It should be recognized that FIG. 1 is essentially schematic in nature and that the dimensions, particularly lengths L1 through L4, are not accurately portrayed in the drawing.

Oil well 10 includes other conventional features and apparatus. Thus, a float shoe or float collar 25, used in cementing the space around casing 21–24, is mounted on or near the lower end of the fourth casing section 24. Well 10 may include production tubing 26 extending coaxially into the well casing; tubing 26 may project down to the bottom of the oil producing formation 14 or even somewhat below that level. Production tubing 26 is usually steel tubing; it may include a section 27 formed of resin-impregnated fiberglass or other electrical insulator material. In the second casing section 22, extending through pay zone 14, a plurality of apertures 28 are shown; these apertures admit oil from producing formation 14 into the interior of the well casing.

Oil well 10, as shown in FIG. 1, includes cement 34 around the exterior of well bore 11, between the various earth formations and the well casing 21–24. Cement 34 is introduced into the well through float shoe 25. As shown, float shoe 25 includes a transverse barrier 35 with a central aperture 36. Aperture 36 is normally closed by a stopper 37 which may be provided with a biasing spring 38. The metal housing 39 of the float shoe includes a bottom aperture 40. Cement 34 is forced, under pressure, outwardly through aperture 36 and through the check valve afforded by that aperture and stopper 37 and its spring 38. The cement passes out through opening 40 in housing 39 and into the space between the various casing sections and the wall of well bore 11. The check valve action of float shoe 25 precludes a return flow of cement.

A part of the electrical heating system for well 10 is a secondary electrode 41 that is driven into the uppermost overburden formation 13 at a relatively short distance from well 10. An electrical power supply 42 is connected to the first conductive casing section 21 and is also connected to the secondary electrode 41. To provide electrical isolation for the first conductive casing section 21, which is usually much longer than any of the other casing sections, an external surface insulator 43 is provided throughout the length L1 of casing section 21. The second casing section 22, in pay zone 14, however, has no external insulation; its conductive surface is bared t the pay zone. Accordingly, this conductive casing section 22 serves as a primary electrode for heating a portion of the oil producing formation 14 adjacent to well 10. That is, electrical current supplied by source 42 flows down through the first casing section 21 to the second casing section 22, the primary electrode of the monopole heating system. From electrode 22 the current flows outwardly into the oil producing formation 14 and then along widely dispersed paths back to secondary electrode 41 and thence is returned to source 42. The heating currents are generally indicated by lines I.

The key to effective operation of the electrical heating system of well 10 is avoidance of wasteful heating of formations above or below the oil producing formation 14. In the upper portion of the well, these undesired heating losses are effectively precluded by the presence of insulator 43 on conductive casing section 21, precluding any significant current flow from this casing section back to the secondary electrode 41. Below the oil producing formation, the electrical isolation is afforded by the third casing section 23, which constitutes an electrical insulator. To be effective, this insulator casing section 23 should have a length L3 of at least three times the diameter of the casing and preferably at least three times the diameter of well bore 11.

A fully effective technique for precluding undesired heating in and around rathole 16 would be simply to extend the insulator, third casing section 23, down to the bottom of rathole 16. This arrangement, however, would be unduly costly and economically impractical. The overall height of rathole 16, approximately the sum of lengths L3 and L4, is subject to substantial variation. For effective use of the rathole, however, this is usually in excess of twenty feet and may be one hundred feet or more. In comparison with steel pipe, this length of fiberglass or other effective electrical insulator pipe is excessively expensive and may not afford the desired strength, impact resistance, and other physical qualities.

On the other hand, even with the length L3 for insulator casing section 23 as specified above, there is a tendency for some of the electrical energy from source 42 to be dissipated as heating currents flowing from the primary electrode, casing section 22, downwardly through the earth formations to the steel or other metal casing section 24 at the bottom of the rathole and then back up to the secondary electrode. To avoid such a parasitic heating effect, electrical insulation 44 should be provided on the external surface of casing section 24 and similar electrical insulation 45 is preferably provided on the inside of that casing section. For the same reason, external insulation 46 should be provided on the metal housing 39 for float shoe 25 and it is preferred that electrical insulation 47 be afforded on the inside of float shoe housing 39, to the extent possible.

FIG. 2 illustrates a rathole-type oil well 110 that incorporates an electrical heating system in accordance with another embodiment of the present invention. Much of well 110 is the same as well 10 (FIG. 1); corresponding reference numerals are employed where applicable.

Thus, oil well 110 utilizes a well bore 11 that extends downwardly from the earth surface 12 through overburden formations 13 and through an oil producing deposit 14, and at its lower extremity affords a rathole 16 within the underburden formations 15. Within well bore 11 there is a first electrically conductive casing section 21 that extends from surface 12 down into the well bore, to a depth adjacent the top of oil producing formation 14. Unlike the previously described well, there is a bottom portion 141 of conductive casing 21 that is not covered by insulation 43. This portion 141 of conductive casing section 21 serves as a secondary electrode in the heating system for well 110; it is separated from the second electrically conductive casing section 22 in well 110 by an insulator casing portion 129.

In well 110, the second conductive well casing section 22 is again provided with perforations 28 for admitting oil into the casing. As before, casing section 22 has an exposed external conductive surface and serves as the primary electrode of the heating system. The construction used in well 110 below casing section 22 is the same as for well 10, comprising the insulator casing section 23, the conductive metal (steel) casing section 24, and the float shoe 25. As before, the fourth casing section 24 is preferably insulated inside and out and this is also true of the conductive housing for float shoe 25.

In well 110, FIG. 2, one terminal of the electrical heating source 42 is connected to the first conductive casing section 21, just as in the previously described embodiment. In this instance, however, the other terminal of electrical supply 42 is connected to the production tubing 26 for the well. Near its bottom end, production tubing 26 is electrically connected to second casing section 22 by an electrical connector 133. In this embodiment of the invention, of course, no insulator section is shown in production tubing 26 because that tubing should be conductive throughout its length in order to afford an effective electrical connection to the primary electrode, casing section 22.

The electrical heating currents developed by the heating system of FIG. 2 are generally indicated by lines I. These dispersed heating currents flow between the primary and secondary electrodes 22 and 141. As in the embodiment of FIG. 1, the conductive elements employed in rathole 16 are effectively isolated from the electrical heating system so that parasitic and other similar heating losses do not occur.

FIG. 2A illustrates a well construction 110A that constitutes a limited modification of the system shown in FIG. 2, a modification that changes the operational characteristics from a monopole to a dipole heating system. Thus, the construction employed in well 110A, FIG. 2A, is the same as in FIG. 2 except that an insulator casing section 229, between the first casing section 21 and the second casing section 22, is now located approximately in the middle of the oil producing formation 14. As a consequence, the second casing section 22, which may be termed the primary heating electrode, is located adjacent the bottom of the pay zone. A bare portion of conductive casing section 21 is positioned within the top of the pay zone 14. In this arrangement, the lower bare portion 241 of conductive casing section 21 serves as the secondary electrode for the heating system. ("Primary" and "secondary" have little significance as applied to these electrodes.) Electrode 241 has a series of perforations or apertures 228; casing section 22, of course, still includes the oil admission apertures 28. As in the embodiment of FIG. 2, the lower end of the conductive production tubing 26 is electrically connected to the heating electrode, casing section 22, by a connector 133. The construction of the system in rathole 16 remains unchanged.

The operation of the heating system for well 110A, FIG. 2A, is essentially similar to well 110, FIG. 2. The electrical currents flow between electrodes 22 and 241 as indicated generally by lines I. Heating is confined to the oil producing formation 14, even more than in previously described embodiments. On the other hand, heat losses in the rathole portion 16 of well 110A, as in the other wells, are negligible.

Figure 3:
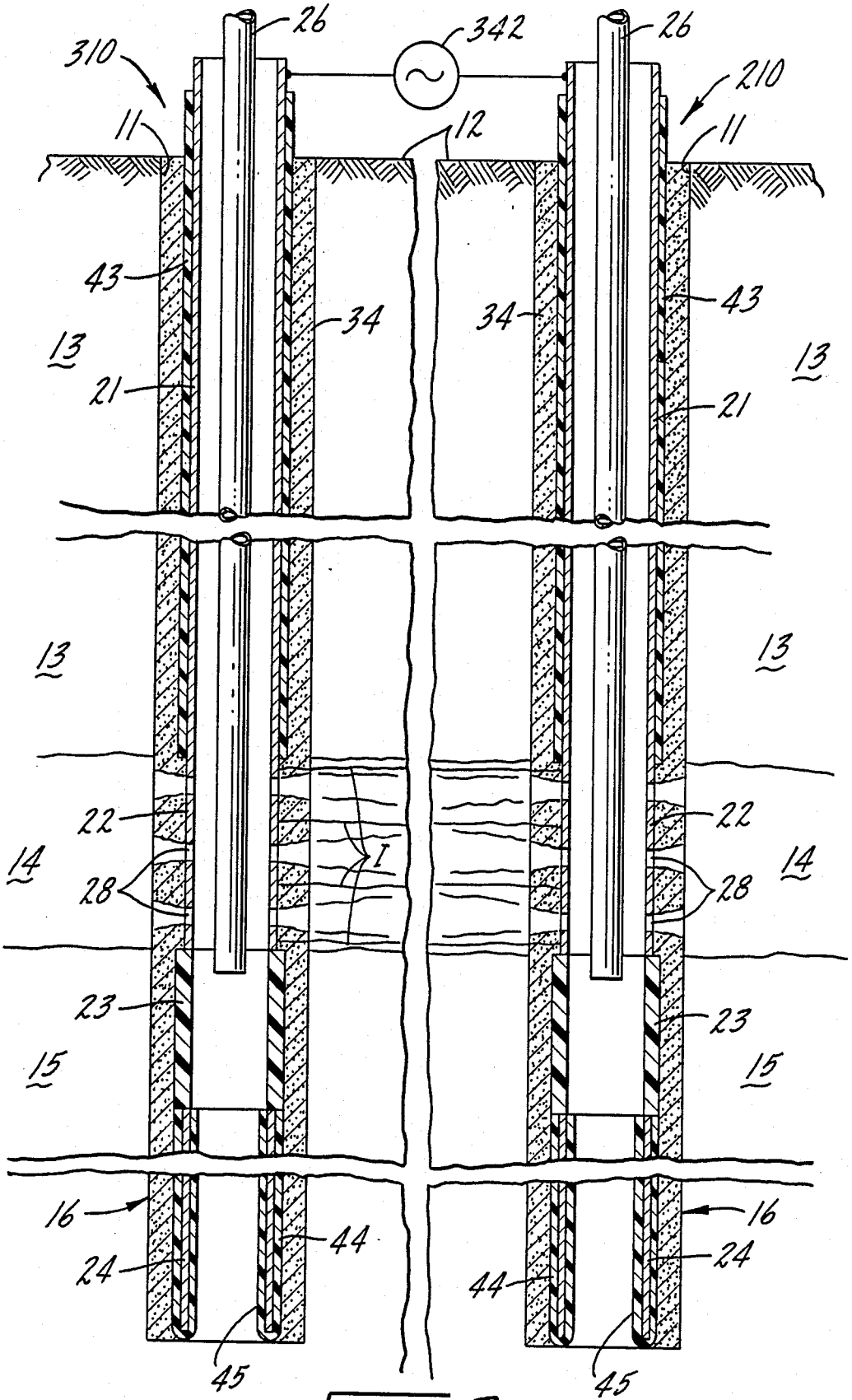
FIG. 3 is a simplified schematic sectional elevation view of two rathole-type oil wells that share an electrical heating system comprising another embodiment of the invention.

FIG. 3 illustrates two wells 210 and 310 incorporated in a heating system which serves both wells from a single electrical power supply 342. As before, well 210 includes a bore 11 extending downwardly from the earth surface 12 through overburden 13, oil producing formation 14, and into a rathole 16 in the underburden 15. Well 210 includes a first electrically conductive casing section 21 having an external insulator coating 43. The insulator coating ends adjacent the top of the oil producing formation 14, which is taken as the lower limit of casing section 21. Continuing downwardly, the well includes a second conductive casing section 22 provided with appropriate perforations 28. Casing section 22 has a bare conductive outer surface and serves as a heating electrode. Below pay zone 14, in rathole 16, the construction remains essentially as previously described. There is an insulator casing section 23, preferably formed of resin impregnated fiberglass, followed by an electrically conductive fourth casing section 24 with external and internal insulator coatings 44 and 45. In this instance, no float shoe has been shown. However, a float shoe could be present. If a float shoe is utilized, and has a conductive housing, then that housing should be insulated internally and externally as previously described.

The adjacent well 310 in FIG. 3 has the same construction as well 210, including the well bore 11, casing sections 21, 22, 23, and 24, and the insulator coatings 44 and 45 on the fourth casing section 24 in rathole 16. As in well 210, the first conductive casing section 21 of well 310 is provided with an external insulator coating 43.

In the system of FIG. 3, the electrical supply 342 is connected to the first or upper casing section 21 in each of the wells 210 and 310. This effectively energizes the two electrode casing sections 22, generating a flow of heating currents I through the oil producing deposit 14 between the electrodes 22 of the two wells. There is no appreciable flow of current downwardly below either of the two electrodes 22, so that no power is wasted in heating formations adjacent the rathole 16. By the same token, there is no appreciable external flow of electrical current between or around the upper portions of either of the wells 210 and 310.

In all of the heating systems of FIGS. 1—3, a bare, uninsulated conductive surface on all or part of the second casing section 22 affords a primary heating electrode positioned within the oil producing formation 14. The secondary (or second primary) electrode is more variable. In one monopole system, well 10 of FIG. 1, the secondary electrode is an independent "ground" electrode driven into the overburden 13 near the well. In another monopole arrangement, well 110 of FIG. 2, the secondary electrode 141 is an uninsulated portion of the first casing section 21; similar "secondary" electrode 241 appears in the dipole heating system of FIG. 2A. In the two-well dipole arrangement of FIG. 3, with the two wells either of the two second casing sections 22 may be called the secondary electrode, the other being the primary.

In all figures the insulator casing section 23 could extend to the bottom of the rathole 16, but this is generally impractical. To preclude energy waste through unwanted heating of the rathole, the third casing section, insulator 23, should have a length L3 of at least three times the casing diameter, and preferably larger than this minimum. Any conductive casing section 24 in the rathole should be insulated on the outside and preferably also on the inside to preclude parasitic heat losses; this is also true for the conductive metal housing of any float shoe 25.

There really is no "typical" oil well, but exemplary data can be provided. Thus, the length L1 of the first casing section 21 may range from several hundred feet to several thousand feet. The length L2 of the primary electrode, casing section 22, varies substantially; a length L2 of the order of twelve feet is not unusual. If the casing diameter is 4.5 inches, as typical, the length of the insulator casing section 23 should be at least about fifteen inches; three or four feet is better. Casing section 23 need not be fiberglass pipe; it may be afforded by cement or grout, other resin materials, or even ceramic materials. The remaining fourth casing section 24 may be short (twenty feet) or long (one hundred feet) depending on anticipated requirements for the rathole capacity.

Other alternative options are possible. For example, instead of inserting an insulator section 23 between the casing 22 in the pay zone or deposit and the casing 24 in the rathole section, the steel casing of the electrode 23 can be extended downward into the rathole but overlaid by insulating material. For this to be effective the internal portions of this extended steel casing must be electrically insulated and the major or preferably all portions of the float shoe should be insulated or made from nonconducting material.

We claim:

1. In a oil well of the kind comprising:

a well bore extending downwardly from the surface of the earth through one or more overburden formations and through an oil producing formation, and further into an unburden formation below the producing formation to afford a rathole of substantial depth;

an electrically conductive first casing section extending from the surface of the earth down into the well bore to a depth adjacent the top of the oil producing formation an electrically conductive second casing section extending downwardly from the first casing section through the oil producing formation;

and a third casing section extending downwardly from the second casing section into the rathole;

an electrical heating system for heating a portion of the oil producing formation, comprising:

at least one portion of the second casing section having an uninsulated surface to afford a primary heating electrode within the oil producing formation;

a secondary electrode positioned within one of the overburden and oil producing formations;

and an electrical power supply connected to the primary and secondary electrodes to energize those electrodes for conduction heating of a portion of the oil producing formation adjacent the well;

in which the third casing section constitutes an electrical insulator casing having a length at least equal to three times the diameter of the well bore, electrically isolating the rathole from the first and second casing sections;

and in which the third casing section is formed essentially entirely of electrical insulator material.

2. An electrical heating system for an oil well of the rathole type, according to claim 1, in which the third casing section extends down to near the bottom of the rathole.

3. An electrical heating system for an oil well of the rathole type, according to claim 1, and further comprising:

a metal fourth casing section extending downwardly from the third casing section to near the bottom of the rathole;

and an electrical insulator covering on the external surface of the fourth casing section to maintain electrical isolation of the rathole.

4. An electrical heating system for an oil well of the rathole type, according to claim 3, and further comprising:

an electrical insulator covering on the internal surface of the fourth casing section.

5. An electrical heating system for an oil well of the rathole type, according to claim 3 and further comprising:

a float shoe, having a metal housing, affixed to the bottom of the fourth casing section;

and an electrical insulator covering on the external surface of the float shoe housing to maintain electrical isolation of the rathole.

6. An electrical heating system for an oil well of the rathole type, according to claim 5 and further comprising:

an electrical insulator covering on the internal surfaces of the fourth casing section and the float shoe housing.

7. An electrical heating system for an oil well of the rathole type, according to claim 1 and further comprising:

an electrical insulator covering on the external surface of the first casing section.

8. An electrical heating system for an oil well of the rathole type, according to claim 7 in which:

the secondary electrode comprises an electrically conductive member inserted into the overburden at a position displaced from the well bore.

9. An electrical heating system for an oil well of the rathole type, according to claim 8, and further comprising:

a metal fourth casing section extending downwardly from the third casing section to near the bottom of the rathole;

and an electrical insulator covering on the external surface of the fourth casing section to maintain electrical isolation of the rathole.

10. An electrical heating system for an oil well of the rathole type, according to claim 9 and further comprising:

an electrical insulator covering on the internal surface of the fourth casing section.

11. An electrical heating system for an oil well of the rathole type, according to claim 9 and further comprising:

a float shoe, having a metal housing, affixed to the bottom of the fourth casing section;

and an electrical insulator covering on the external surface of the float shoe housing to maintain electrical isolation of the rathole.

12. An electrical heating system for an oil well of the rathole type, according to claim 11 and further comprising:

an electrical insulator covering on the internal surfaces of the fourth casing section and the float shoe housing.

13. An electrical heating system for an oil well of the rathole type, according to claim 1, and further comprising:

an electrical insulator covering on most of the external surface of the first casing section, from the earth surface down to a point near the top of the oil producing formation;

an intermediate electrical insulator casing section interposed between the first and second casing sections to isolate those sections electrically;

the lowermost portion of the first casing section having an uninsulated surface and constituting the secondary electrode.

14. An electrical heating system for an oil well of the rathole type, according to claim 13 and further comprising:

an electrically conductive production tubing extending downwardly through the well bore, within the casing but electrically insulated from the first casing section;

and an electrical connector connecting the tubing to the second casing section.

15. An electrical heating system for an oil well of the rathole type, according to claim 14, and further comprising:

a metal fourth casing section extending downwardly from the third casing section to near the bottom of the rathole;

and an electrical insulator covering on the external surface of the fourth casing section to maintain electrical isolation of the rathole.

16. An electrical heating system for an oil well of the rathole type, according to claim 15 and further comprising:

an electrical insulator covering on the internal surface of the fourth casing section.

17. An electrical heating system for an oil well of the rathole type, according to claim 15 and further comprising:

a float shoe, having a metal housing, affixed to the bottom of the fourth casing section;

and an electrical insulator covering on the external surface of the float shoe housing to maintain electrical isolation of the rathole.

18. An electrical heating system for an oil well of the rathole type, according to claim 17 and further comprising:

an electrical insulator covering on the internal surfaces of the fourth casing section and the float shoe housing.

19. An electrical heating system for an oil well of the rathole type, according to claim 1 in which the heating system heats the oil producing formation between two oil wells, and in which the primary and secondary electrodes each comprise the second casing section in one of the wells.

* * * * *